US005251769A

United States Patent [19]

Battegazzore

[11] Patent Number: 5,251,769

[45] Date of Patent: Oct. 12, 1993

[54] TAMPERPROOF CLOSURE FOR BOTTLES AND THE LIKE

[75] Inventor: Piero Battegazzore, Alessandria, Italy

[73] Assignee: Guala S.p.A., Alessandria, Italy

[21] Appl. No.: 955,666

[22] Filed: Oct. 2, 1992

[30] Foreign Application Priority Data

Oct. 17, 1991 [IT] Italy ..... MI91A002754

[51] Int. Cl.[5] ..... B65D 41/34

[52] U.S. Cl. ..... 215/252; 215/253

[58] Field of Search ..... 215/252, 258, 253

[56] References Cited

U.S. PATENT DOCUMENTS 3,850,328 11/1974 Guala ..... 215/252

4,458,817 7/1984 Guala ..... 215/252 X 4,572,387 2/1986 Luker et al. ..... 215/252

*Primary Examiner*—Allan N. Shoap

*Assistant Examiner*—Paul A. Schwarz

*Attorney, Agent, or Firm*—Notaro & Michalos

[57] ABSTRACT

A tamperproof closure, effective to make any opening attempt irreversibly evident, comprises a cylindrical body adapted for association with a bottle, a cap, a thread connection between the cap and the cylindrical body, a tamperproofing band made unitary with the cap through a weakening line, a plurality of teeth distributed around the cylindrical body and a corresponding plurality of cams distributed around the band, each cam being located before a respective tooth in the unscrewing direction of the cap and interfering with the tooth during the unscrewing operation so as to be displaced outwardly and distort the band locally into a projection.

13 Claims, 3 Drawing Sheets

TAMPERPROOF CLOSURE FOR BOTTLES AND THE LIKE

FIELD AND BACKGROUND OF THE INVENTION

This invention relates to a tamperproof closure for bottles and the like.

Such closures which are, well known and widely accepted, provide evidence of a bottle having been opened in that, upon the initial unscrewing of their cap, a tamperproofing band and the cap separate along a weakening line.

It has been found, however, that the bottle tampering can be disguised by setting the band back against the cap. Thus, an inattentive buyer may be under the impression that an intact bottle has been offered to him or her.

SUMMARY OF THE INVENTION

The underlying problem of this invention is to provide a closure of the above-specified type which has such construction and performance features as to obviate the aforementioned drawback.

The solution to the above technical problem is to provide a tamperproofing band which becomes distorted during the unscrewing act such that it can no longer be restored to its original appearance.

BRIEF DESCRIPTION OF THE DRAWINGS

Further features and the advantages of a closure according to the invention will become apparent from the following detailed description of a preferred embodiment thereof, given by way of example and not of limitation with reference to the accompanying drawing figures, whereof.

DESCRIPTION OF THE PREFERRED EMBODIMENTS

Figure 2:
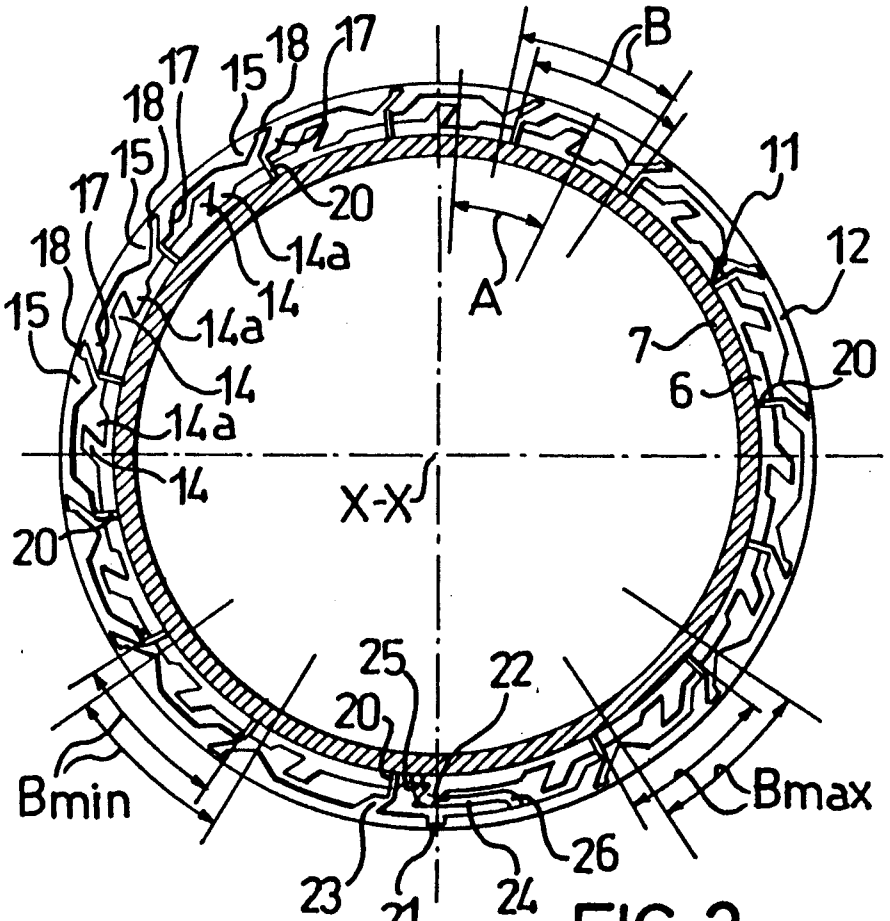
FIG. 2 is a sectional plan view of the closure of FIG. 1.

With reference to the drawing figures, generally shown at 1 is a tamperproof closure for a bottle 2, of which the mouth portion only has been shown.

The closure 1 comprises a cylindrical body 3 about an axis x—x which is associated with the mouth of the bottle 2 and includes a refill-preventing valve 4, basically a check valve, a pour body 5, and a sleeve 6 which is fitted over the bottle mouth to retain the refill-preventing valve 4 and pour body 5 securely on the bottle mouth.

The closure 1 also includes a cap-type stopper 7. An outside threadway 8, formed on the pour body 5, and an inside threadway 9, formed on the cap 7, form a thread connection 10 for screwing and unscrewing the cap onto/off the cylindrical body by a rotary movement about the axis x—x in the direction of arrow F (FIGS. 4 and 5) to unscrew, and in the opposite direction to screw on.

An annular tamperproofing band 12 is made unitary with the cap 7 through a weakening line 11.

A cap top 13 is fitted snugly over the cap 7 which extends as far as the tamperproofing band 12 and is made preferably of a material contrasting in color with the material from which the cap and tamperproofing band are formed.

Figure 1:
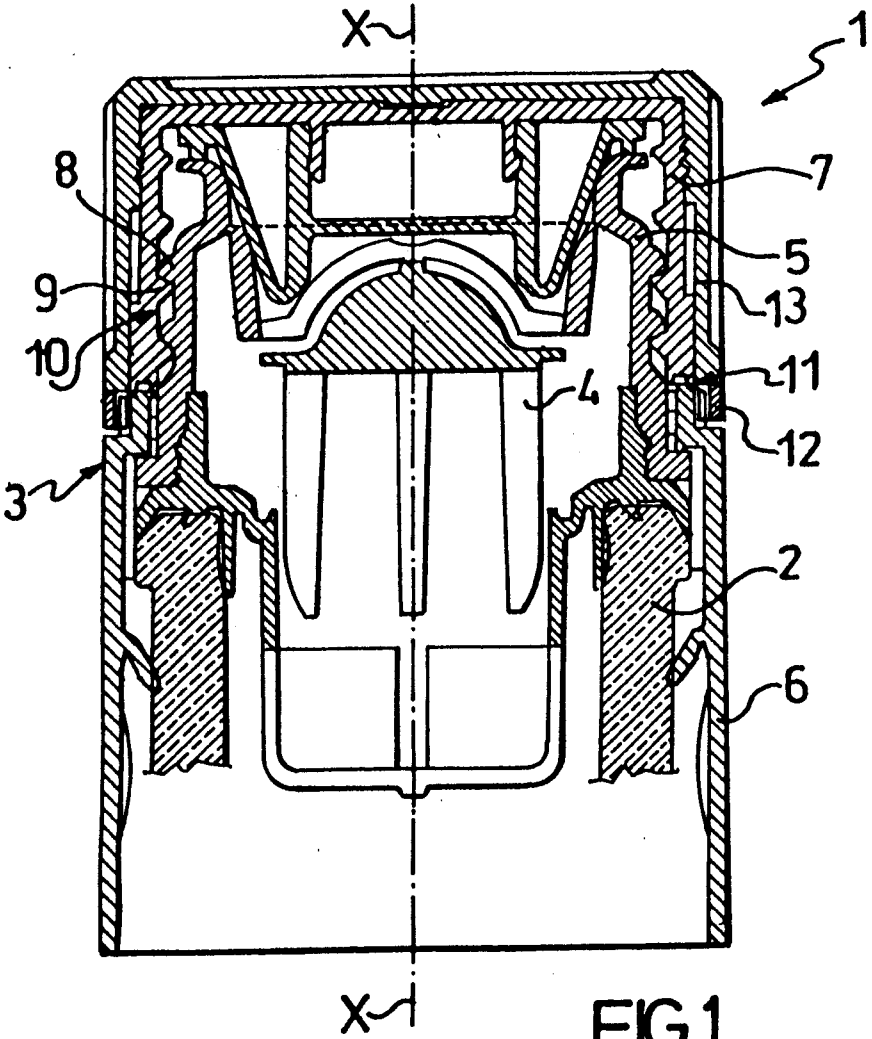
FIG. 1 is a sectional elevation view of a closure according to the invention.
Figure 3:
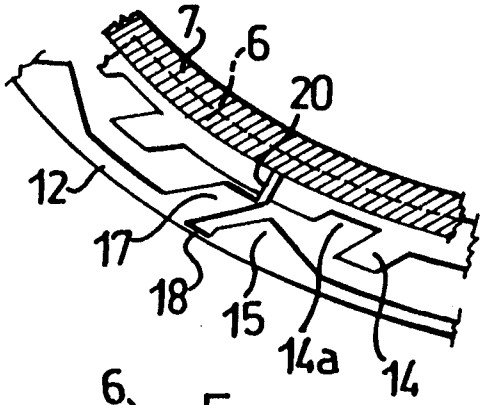
FIG. 3 is a partial sectional view of the closure of FIG. 1 at a first stage of operation.
Figure 4:
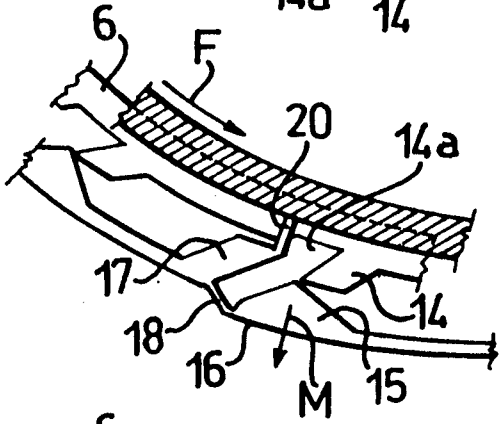
FIG. 4 is a partial sectional view of the closure of FIG. 1 at a second stage operation.
Figure 5:
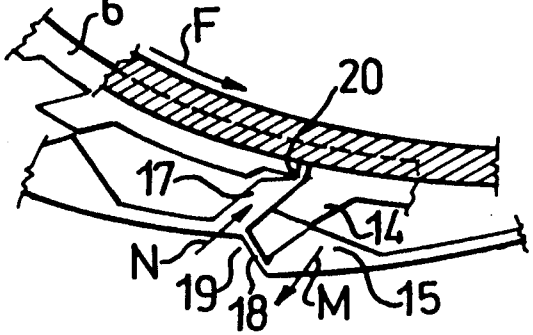
FIG. 5 is a partial sectional view of the closure of FIG. 1 at a third stage of operation.

The closure 1 has a plurality of teeth 14, (FIG. 3) fourteen of them in this example, which are formed integrally with the sleeve 6 of the cylindrical body 3, as shown in FIG. 1, and distributed around the cylindrical body at angular pitch distances A (FIG. 2), and raked backwards with respect to the cap unscrewing direction F (FIGS. 4 and 5).

The closure 1 further comprises a corresponding plurality of cams 15 which are formed integrally with the band 12 and are distributed around the band at angular pitch distances B varying gradually from a minimum pitch distance B MIN slightly longer than pitch A to a maximum pitch distance B MAX as shown in FIG. 2.

Each cam 15 locates before a respective one of teeth 14 in the cap unscrewing direction F and interferes with the teeth 14 during the unscrewing operation, whereby it will be displaced outwards in the direction of arrow M to produce local distortion of the band into a projection 16 as shown in FIG. 2.

The closure 1 also comprises a corresponding plurality of counter-teeth 17 which are formed integral with the band 12 and distributed around the band 12 at the same pitch distances B, varying-between a minimum and a maximum length, as the cams 15 as illustrated in FIG. 2.

Each counter-tooth 17 locates after a respective cam 15, a predetermined short distance away. Across this distance, the band 12 has reduced thickness to define a deformable bond 18.

Each counter-tooth 17 will interfere, during the unscrewing operation, with its respective tooth 14 and be urged inwardly in the direction of arrow N, to produce local distortion of the band into a depression 19 as shown in FIG. 5. When urged inwardly, each counter-tooth fits with its head into a recess 14*a* provided in the sleeve 6 before each tooth 14 as illustrated in FIG. 2.

Upon the band 12 becoming distorted into a projection 16 and a depression 19, the bond 18 arranges itself diagonally from its original, circumferentially oriented position.

Between the cap 7 and the ends of the counter-teeth 17 of the band 12, there extend rupture bridges, all denoted by 20, which are formed integral with the cap 7 and the band 12, said bridges 20 forming in combination the weakening line 11 as illustrated in FIG. 2.

At a location between the first cam in the plurality of cams 15 and the last counter-tooth in the plurality of counter-teeth 17, the band is made thinner into a weak rupture bridge denoted by 21.

A stop 22 juts out from the cylindrical body 3 with which a counter-stop 23 jutting out from the band 12 will interfere as the cap 7 is being unscrewed.

The counter-stop 23 locates before the bridge 21 a distance away from the stop 22 which is smaller than the minimum pitch B MIN.

Upon unscrewing, the engagement of the counter-stop 23 with the stop 22 results in the bridge 21 being ruptured and the band opened into a C-like configuration.

Located Proximate to the bridge 21, the stop 22 and the counter-stop 23, is a tang 24, extending circumferentially and having an end 25 led to the cap 7 and an opposite end 26 led to the band 12 at a location after the rupture bridge 21.

The tang 24 has length and cross-section selected to enable the tang to accept a degree of elongation without breaking.

It establishes a connection between the cap 7 and the band 12 to prevent the band from coming loose upon rupture of the bridge 21 and the bridges 20 forming the weakening line.

Figure 7:
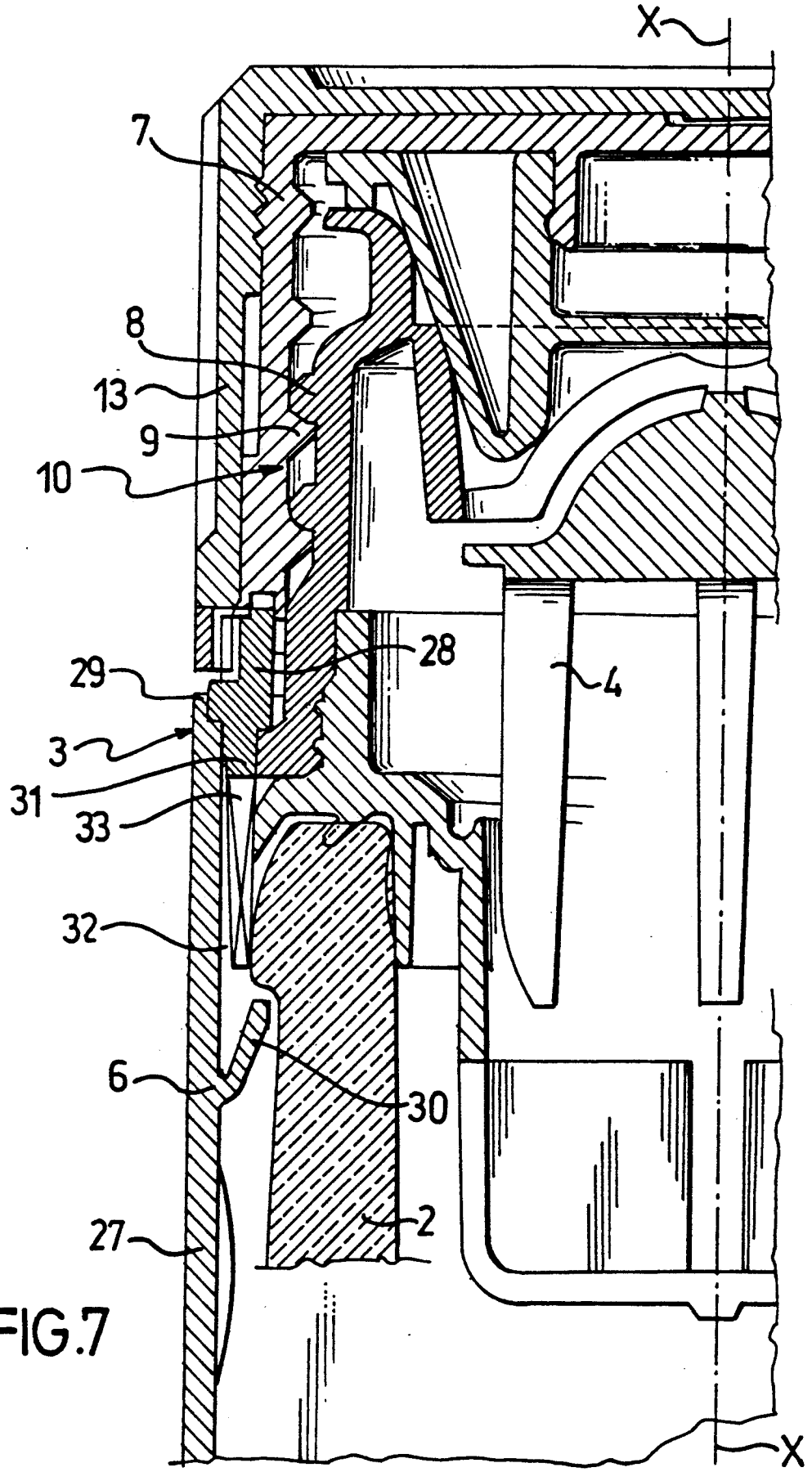
FIG. 7 is a sectional elevation view of a detail of a closure according to a second embodiment of the invention.

In a modified embodiment (see FIG. 7), the sleeve 6 is formed with a tubular portion 27 and an annular Portion 28 welded together, such as by ultrasonic welding.

The tubular portion 27 has an upper edge 29 to which the annular portion 28 is welded, and small tongues 30 extending approximately halfway up and being oriented inwardly toward the upper edge.

The annular portion 28 that retains the pour body and refill-preventing valve to the bottle, is welded externally to the edge 29 and provided with a tubular extension 31 inserted coaxially into the tubular portion 27 and defining an annular interspace 32 in cooperation therewith. The tubular extension 31 is comb-like in shape with teeth 33 which fit over the bottle mouth.

Preferably, the tubular portion 27 and annular portion 28 are both formed from a rigid plastic, e.g. polystyrene.

In applying the closure 1 to the bottle, the tongues 30 will snap over the bottle mouth and hold the closure axially to the bottle while the teeth 33 fit over the mouth, being free to flex outwards by reason of the interspace 32 provided, to bold the closure radially to the bottle.

The operation of the inventive closure 1 will now be described with reference to an initial condition such as that depicted in FIGS. 1, 2 and 3.

As the cap is first unscrewed in the direction of arrow F (FIGS. 4 and 5), the band will be entrained in the same direction by the bridges 20.

As a first result, the counter-stop 23 becomes engaged with the stop 22 and the bridge 21 is at once ruptured as shown in FIG. 2.

As the unscrewing progresses, with the attention focussed on the first tooth 14, the first cam 15 will engage with that tooth and cause the projection 16 to be formed which imparts to the band 12 at that location the appearance of an apex of a polygon (see FIG. 4). Then, the first counter-tooth 17 engages with that tooth and the depression 19 is formed (see FIG. 5). It should be noted that the counter-tooth 17 is dragged by the bridge 20, which promotes formation of the depression 19 in cooperation with the tooth rake 14 providing an invitation for the counter-tooth rake 17, until as the unscrewing progresses the bridge 12 is ruptured under tension and shear stresses.

Figure 6:
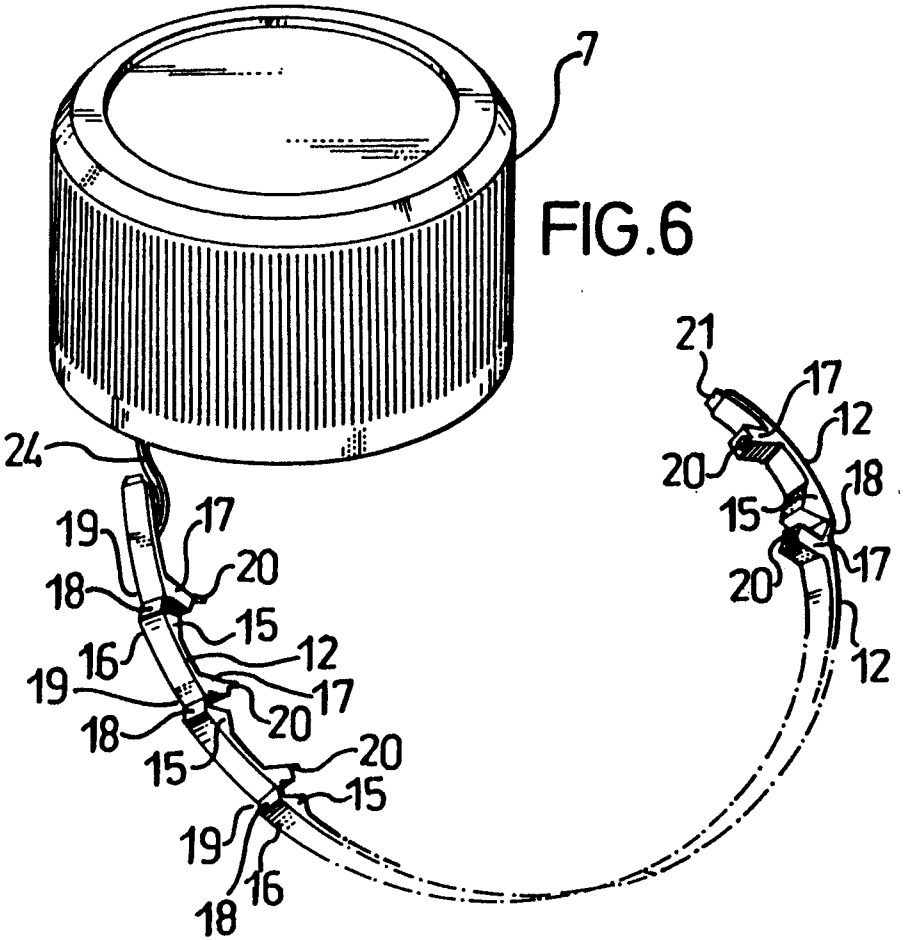
FIG. 6 is a perspective view of a detail of the closure of FIG. 1 at a further stage of its operation.

Concurrently therewith, the bond 18 will take a cocked or diagonal set, whereby the combination of the depression 12, projection 16 and bond 18 impart the appearance of a "Z" letter to the band 12 at that location as illustrated in FIG. 6.

What has occurred of the first tooth 14 is repeated in an identical way with all the other teeth 14, with a delay between each tooth 14 and the next due to the cam 15 and counter-tooth 17 pitches changing. Thus, the effort to be exerted to unscrew the cap will be smooth instead of being concentrated on a single peak.

Once all the bridges from bridge 21 through bridges 20 have been ruptured, the band 12, presently opened into a C-like configuration, will stay attached to the cap 7 by the tang 24 (see FIG. 6).

The band 12, due to the successive projections and depressions, that is the Z-like regions, thus created in it, will take on the whole the appearance of a sawtooth broken liner quite different from its originally annular appearance.

A major advantage of a closure according to the invention is that the tampering is made quite evident by the consequent awkward appearance taken by the tamperproofing band.

A further advantage of the closure of this invention is that it cannot be practically restored to its original condition, not even by the most skillful and patient exertion, owing to the band distortion into projections and depressions leaving the band material in an irreversible state.

Another advantage of a closure according to this invention is that it provides for safety and environmental protection. When opened, none of its parts are expended because the tamperproofing band stays with the cap due to being held by the tang.

The closure of this invention is also advantageous from an ergonomic standpoint because it can be opened with a moderate and smooth effort.

Additionally, the inventive closure can be manufactured by an injection molding process from suitable plastics in a rapid and economical way.

Another advantage of a closure according to the invention resides in its improved resistance to tampering with the bottle. This is because the sleeve is formed of portions made of a rigid plastic, which cannot be readily deformed, such as by prolonged submersion in hot water, in order to dislodge it from the bottle. Thus, the sleeve is virtually undeformable.

Still another advantage of the inventive closure is that it can accommodate bottles with a mouth size varying within a broad range of tolerances. In fact, because of the interspace the extension teeth are allowed to flex as required without any distortion being communicated to the tubular portion.

From this, the added advantage stems from having these closures all perfectly alike and faultless in appearance, even with bottles having a mouth size close to the upper tolerance limit.

Understandably, the closure described above may be altered and modified in many ways by skilled persons in the art to fulfill specific and contingent requirements, still within the protection and scope of the invention as defined in the appended claims.

I claim:

1. A tamperproof closure for bottles comprising:

a cylindrical body adapted for association with a bottle;

a cap;

thread means on the cylindrical body and the cap for removably screwing the cap to the cylindrical body;

a distortable band fixed circumferentially around the cap, the distortable band having a weakening line between the distortable band and the cap;

a plurality of teeth circumferentially arranged around the cylindrical body and raked rearwardly in a cap unscrewing direction;

a plurality of counter-teeth circumferentially arranged around the distortable band, each counter-tooth positioned a predetermined distance from a respective tooth of the cylindrical body, each counter-tooth raked forwardly in the cap unscrewing direction, and each counter-tooth engaging a respective tooth of the cylindrical body during an unscrewing of the cap, such that each counter-tooth is drawn toward the distortable band for forming a depression in the distortable band when the cap is unscrewed in the unscrewing direction; and a plurality of cams circumferentially arranged around the distortable band, each cam positioned between a respective tooth and a respective counter-tooth such that when the cap is unscrewed in the unscrewing direction the cam engages the respective tooth displacing the cam outwardly from the distortable band and forming a projection in the distortable band.

2. A tamperproof closure according to claim 1, wherein the band has a reduced thickness between each can and each counter-tooth for defining a deformable bond which is positioned diagonally between the projection and the depression of the distortable band upon the unscrewing of the cap.

3. A tamperproof closure according to claim 2, wherein the weakening line comprises a plurality of rupture bridges extending between the counter-teeth and the cap.

4. A tamperproof closure according to claim 3, wherein the teeth, the cams and the counterteeth are arranged such that each tooth, each can and each countertooth is separated from an adjacent tooth, an adjacent cam and an adjacent countertooth respectively by a pitch distance, the pitch distance between the cams and the counterteeth gradually increasing from a minimum value to a maximum value.

5. A tamperproof closure according to claim 4, wherein the distortable band includes a weak rupture bridge at a location on the distortable band between a cam and a counter-tooth of the distortable band.

6. A tamperproof closure according to claim 5, wherein the cylindrical body includes a stop jutting out from the cylindrical body near the weak rupture bridge of the distortable band and the distortable band further includes a counter-stop jutting out from the distortable band near the weak rupture bridge, the counter-stop being located near the stop at a distance shorter than the minimum value of the pitch distance such that when the cap is unscrewed in the unscrewing direction, the counter-stop engages the stop thereby causing the weak rupture bridge to rupture from the distortable band and allowing the distortable band to be separated from the cap in a C-shaped configuration.

7. A tamperproof closure according to claim 6, wherein the closure further comprises a tang connected between the cap and the distortable band near the weak rupture bridge for preventing the distortable band from being completely separated from the cap.

8. A tamperproof closure according to claim 1, wherein the cylindrical body includes a sleeve comprising a tubular portion and an annular portion welded together.

9. A tamperproof closure according to claim 8, wherein the tubular portion has tongues directed inwardly toward an upper edge in order to retain the closure axially to the bottle.

10. A tamperproof closure according to claim 9, wherein the annular portion includes a tubular extension inserted coaxially into the tubular portion and defining an interspace in co-operation therewith for retaining the closure radially to the bottle.

11. A tamperproof closure according to claim 10, wherein the tubular extension has a comb-like shape and comprises teeth adapted to fit over a bottle mouth.

12. A closure according to claim 11, wherein the tubular portion and the annular portion are formed from a rigid plastic.

13. A tamperproof closure according to claim 12, wherein the tubular portion and the annular portion are formed from polystyrene.

* * * * *